US007361028B1

(12) United States Patent
Polnyl

(10) Patent No.: US 7,361,028 B1
(45) Date of Patent: Apr. 22, 2008

(54) ELECTRICAL CONNECTOR

(75) Inventor: Igor Polnyl, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/647,627

(22) Filed: Dec. 28, 2006

(51) Int. Cl.
*H01R 12/00* (2006.01)

(52) U.S. Cl. ..... 439/68; 439/526

(58) Field of Classification Search ..... 439/68–71, 439/73, 330, 331, 525, 526
See application file for complete search history.

(56) References Cited

U.S. PATENT DOCUMENTS 7,207,808 B2 * 4/2007 Ma ..... 439/71
2005/0014400 A1 * 1/2005 Liao et al. ..... 439/73

* cited by examiner

*Primary Examiner*—Ross Gushi
(74) *Attorney, Agent, or Firm*—Wei Te Chung

(57) ABSTRACT

An electrical connector (100) for connecting a chip module to a printed circuit board comprises an insulative housing (1) of a substantially rectangular shape defining a receiving area (130) with sidewalls therearound, the receiving area (130) defining a number of passageways (1300) therethrough, a number of terminals (3) receiving in corresponding passageways (1300) of the housing (1), wherein at least one detachable datum member (2) is engaged on the housing (1) for providing a datum surface (233) for a chip module received in the housing (1). In assembly, the housing (1) can provide more areas for defining passageways (1300) for receiving the terminals (3), because the datum member (2) is defined detachable with the housing (1). When the passageways (1300) made or the terminals (3) inserted, the datum members (2) are removed from the housing (1) for providing an enlarged space. Thus, as compared with the prior art, an insulative housing with enlarged passageways area is achieved, thereby the connector can transmit more signal and current than over.

11 Claims, 7 Drawing Sheets

2

A

ELECTRICAL CONNECTOR

BACKGROUND OF THE INVENTION

1. Field of the Invention

The present invention relates to the art of electrical connectors, and more particularly to an electrical connector for connecting a chip module to a printed circuit board.

2. Description of the Related Art

One type of the connectors 100' is shown in FIG. 1 for electrically connecting an IC package (not shown) and a printed circuit board (not shown). The connector 100' typically includes an insulative housing 1' of a generally rectangular shape, a plurality of conductive terminals 2' held within the insulative housing 1', the housing 1' defines a receiving area enveloped by four sidewalls comprising a first opposite sidewalls 11' and second opposite sidewalls 12' therearound for defining a plurality of passageways 1000' therethrough for receiving the terminals 1' therein. The sidewalls integrated define a number of datum members 110' for providing a datum surface 1100' to give a datum to the chip module abutting thereagainst. With the electronic technology development, the terminals density of electronic devices increases quickly which requests a housing with more passageways than ever for transmitting more currents and signals to get a better process speed. However, connectors 100' abovementioned usually provide a datum member 110' integrated with the housing 1', which protrude outwardly toward the receiving area 10', hence decreasing the receiving area 10' are for defining passageways 1000' to receive terminals 2'. In the case, the integrated datum 110' of the housing 1' wastes some place, which could be defining more passageways.

What is needed, thereby, is a new electrical connector able to overcome the problem abovementioned.

SUMMARY OF THE INVENTION

An object of the present invention is to provide an electrical connector assembly which can provide an improved receiving area for receiving more terminals for enhancing the speed and signal transmitted by the connector.

An electrical connector according to an embodiment of the present invention includes an insulative housing of a substantially rectangular shape, and a plurality of terminals received in said housing. In addition, the connector further comprises a number of moveable datum members for providing a datum wall to the chip module. In manufacture, the housing can provide more areas for defining passageways for receiving the terminals, because the datum member is defined as detachable with the housing. When the passageways made or the terminals inserted, the datum members are removed from the housing for providing an enlarged space. Thus, as compared with the prior art, an insulative housing with enlarged passageways area is achieved, thereby the connector can transmit more signal and current than over.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
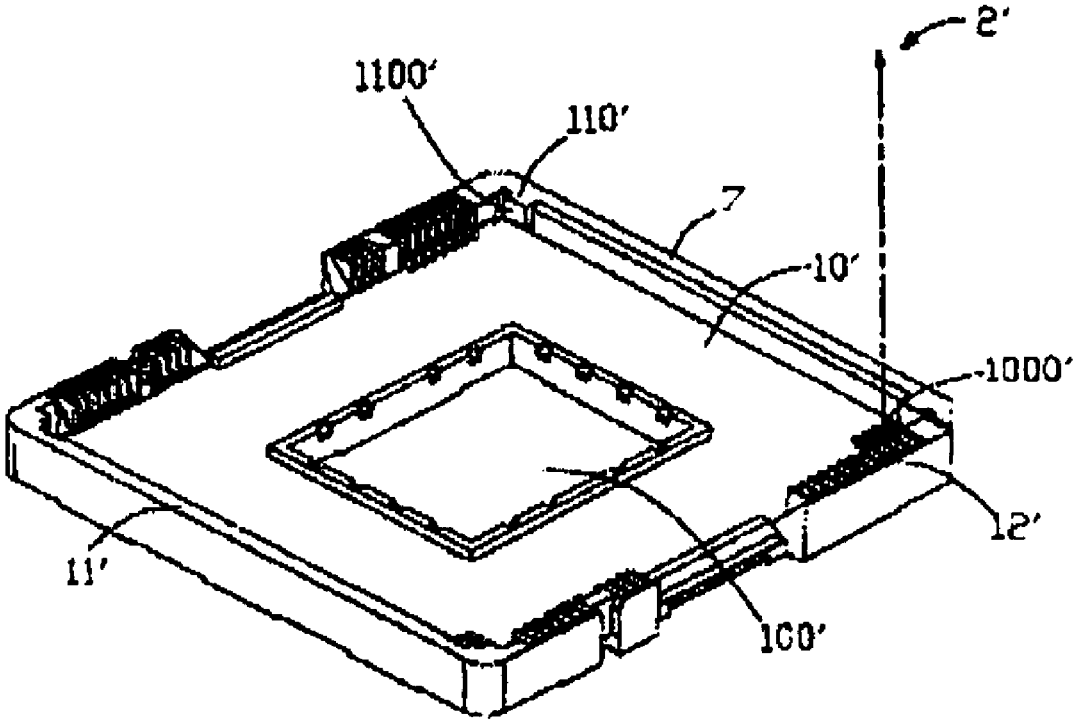
FIG. 1 (PRIOR ART)
FIG. 1 is an exploded, perspective view of a conventional connector according to a preferred embodiment of the present invention.
Figure 2:
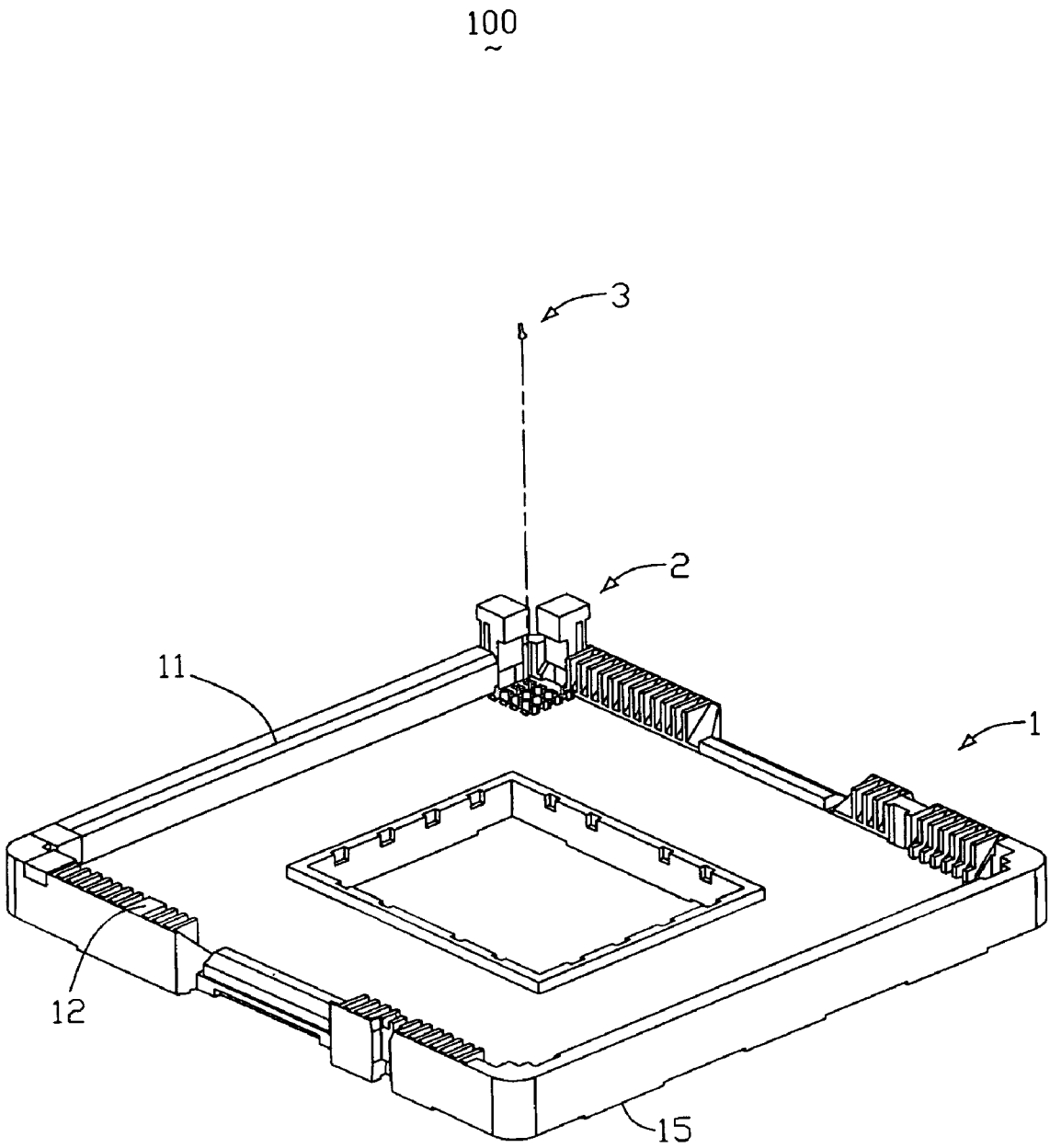
FIG. 2 is an exploded, perspective view of an electrical connector according to a preferred embodiment of the present invention, wherein the datum members are partially inserted into the housing.
Figure 3:
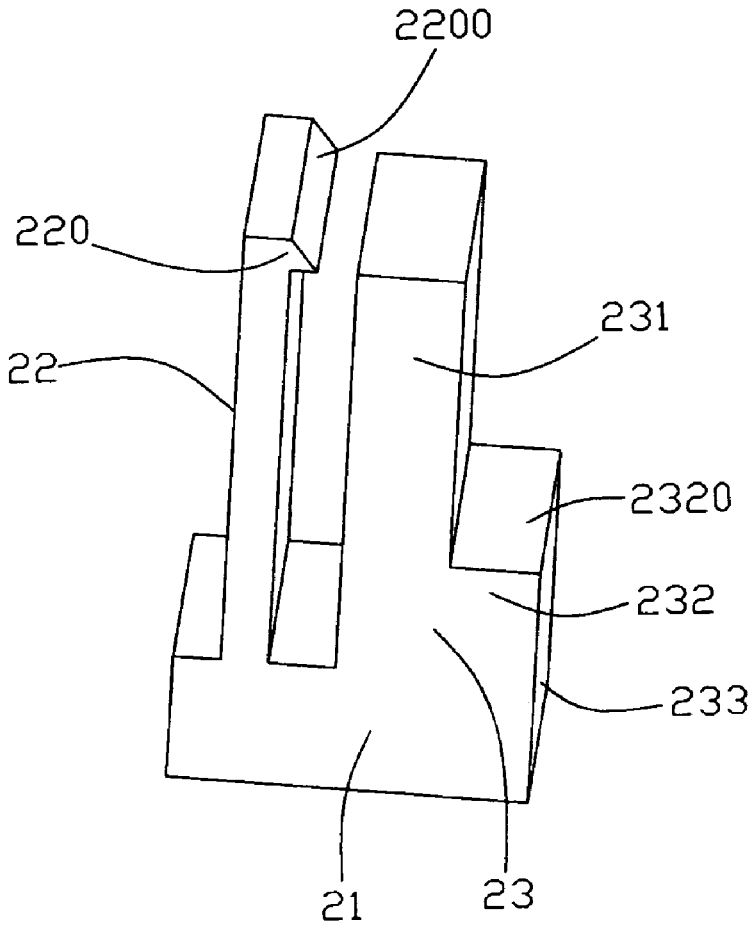
FIG. 3 is an enlarged view of the datum member of the connector in FIG. 2.
Figure 4:
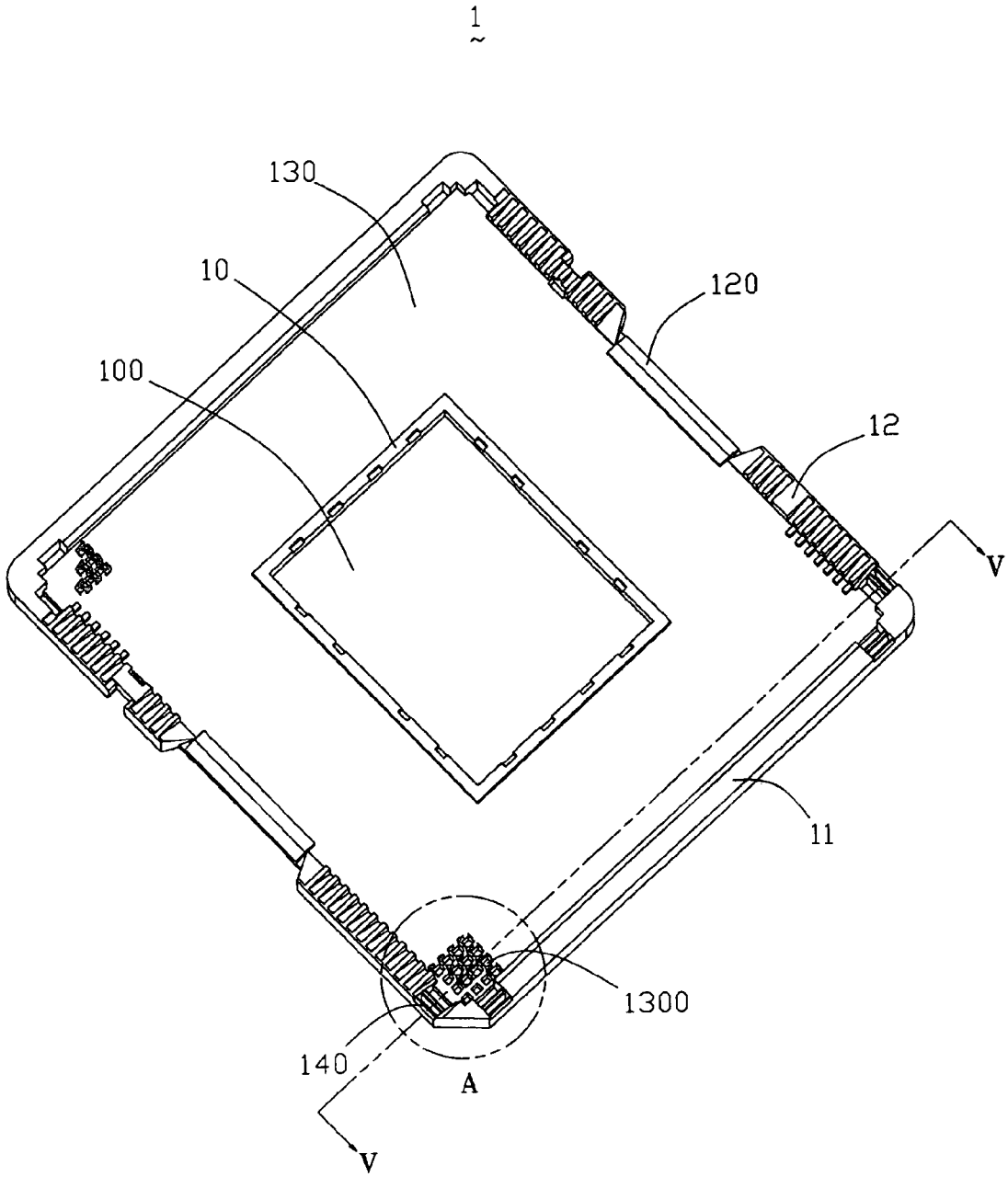
FIG. 4 is a perspective view of the housing of the connector in FIG. 2, but with the datum members removed therefrom.
Figure 5:
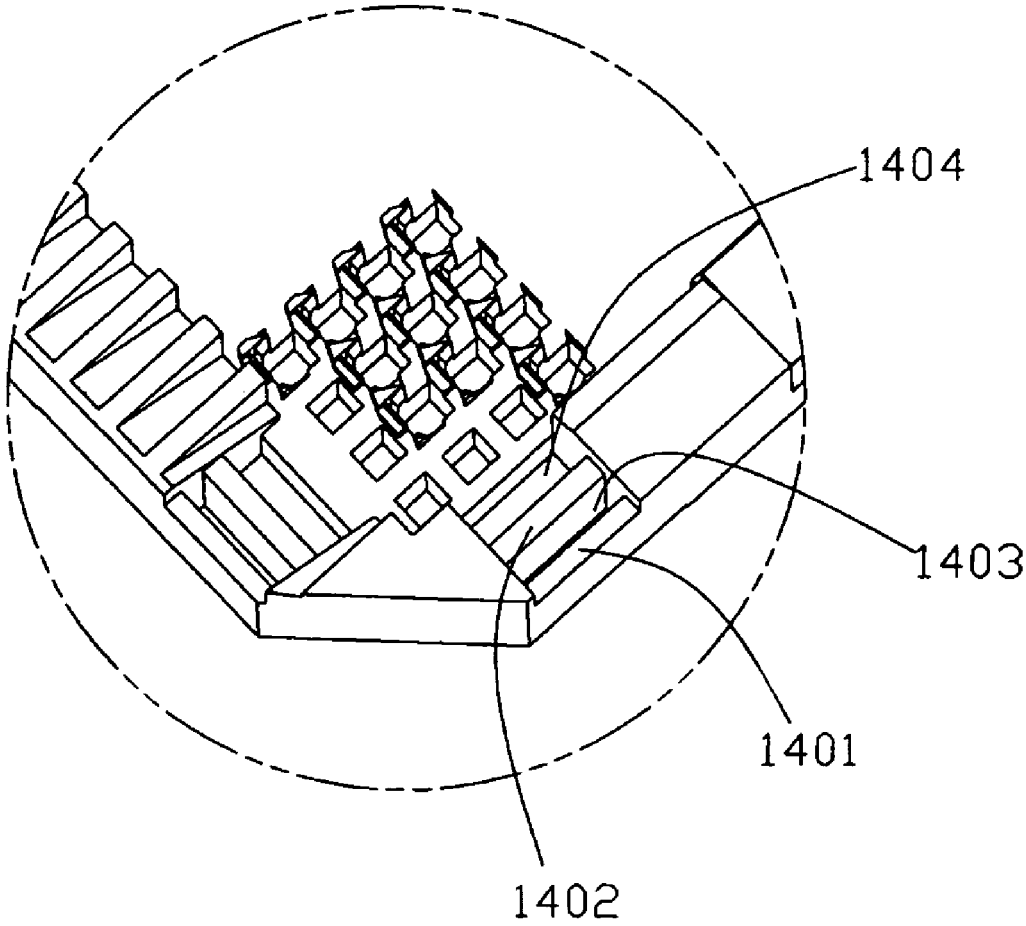
FIG. 5 is an enlarged view of a circle part A of the connector of FIG. 4.
Figure 6:
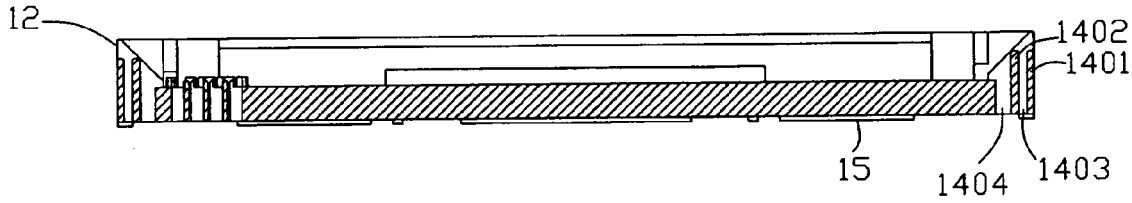
FIG. 6 is a cross-sectional view of the connector of FIG. 4, cut in line V-V.
Figure 7:
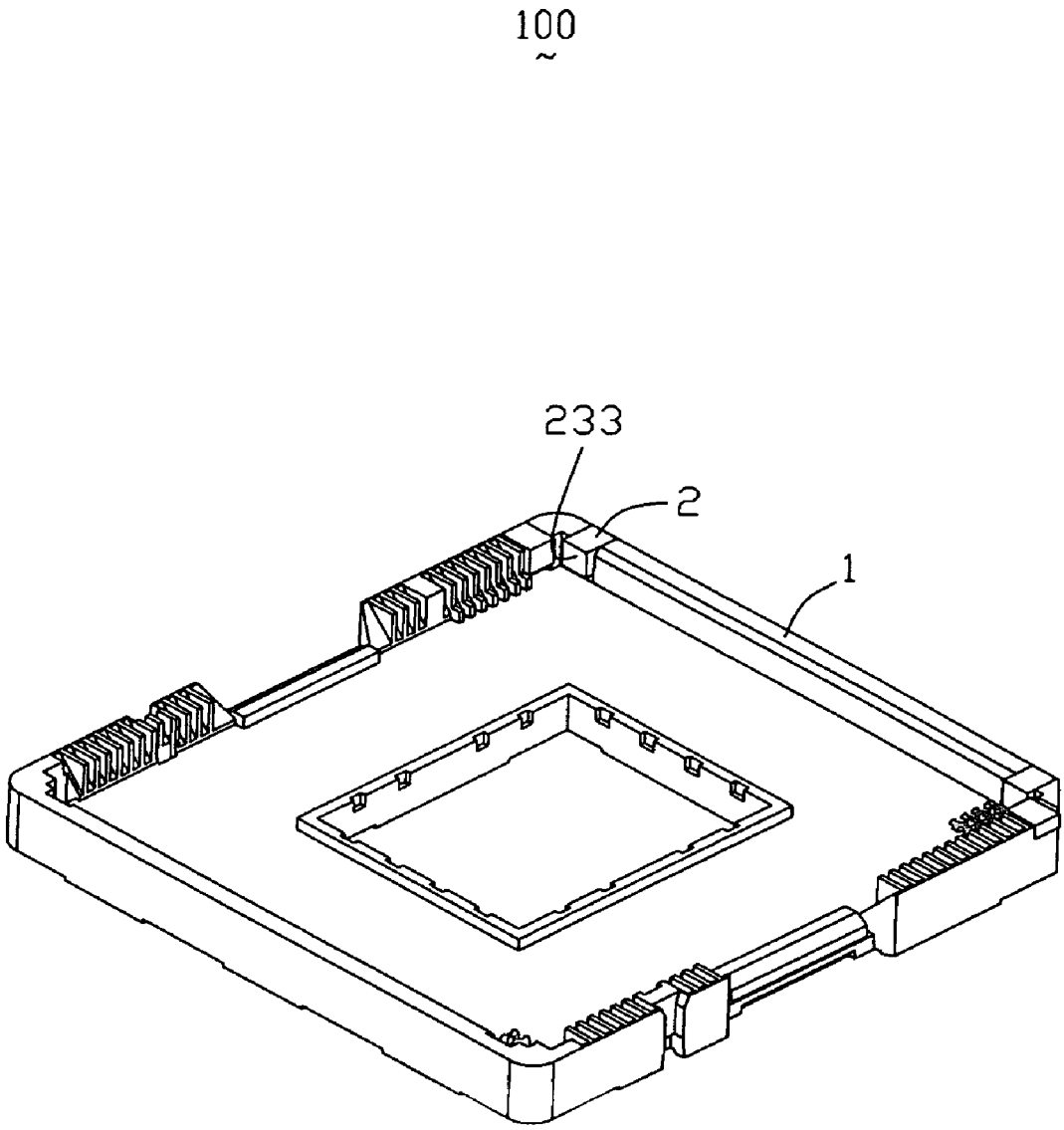
FIG. 7 is an assembled view of the connector shown in FIG. 2.

Referring to FIGS. 2 to 7, an electrical connector 100 according to the preferred embodiment of the present invention is shown for electrically connecting an IC package (not shown) and a printed circuit board (not shown). The connector 100 includes an insulative housing or body 1 of a generally rectangular shape, a plurality of conductive terminals 3 held within the insulative housing 1, a number of moveable datum members 2 inserted into the housing 1 for providing a datum surface 233 to the chip module thereon.

The insulative housing 1 defines a pair of opposite first sidewalls 11 and a pair of second sidewalls 12, each defining a concave defining a elongated supporting member 120 thereof for supporting the chip module thereon and a receiving area 130 enveloped by the first sidewalls 11 and second sidewalls 12, and a supporting bracket 10 with a rectangular shape in a center of the receiving area 130 with a cavity 100 in a central portion thereof. In addition, the housing 1 further defines a number of receiving recesses 140 adjacent to the corners thereof for receiving the datum member 2 therein. The receiving recess 140 comprises a first recess 1403 and a second recess 1404 adjacent to the first recess 1403 and both arranged on the sidewalls adjacent to the corners thereof in a thickness direction. The first recess 1403 is separated with the second recess 1404 with a separating wall 1402 with a lower height than that of the second sidewalls 12 or the first sidewalls 11. The first recess 1403 is sandwiched by the separating wall 1402 and a third sidewall 1401 with a same height than that of the separating wall 1402.

Each of the datum member 2 includes a base portion 21, an engaging portion 22 extending upwardly from the base portion 21, a leading portion 23 extending from the base portion 21 substantially parallel to the engaging portion 22 and disposed separately with the engaging portion 22. The engaging portion 22 defines a hook portion 2200 on a distal end thereof for engaging with a bottom side of the housing 1. In the embodiment, the engaging portion 22 is disposed far away with the side surfaces of the base portion 21 with a preferred distance. The leading portion 23 defines a heighter portion 231 for being inserted into the second recess 1404 of the housing 1 and a lower portion 232 for engaging with a lateral side of the receiving area 130 of the housing 1. The lower portion 232 defines a datum surface 233 for providing a datum plane for the chip module mounted thereon. In addition, the hook portion 2200 of the engaging portion 22 extends from a side facing the leading portion 23 with a slant surface 2200 for simplifying the engaging with a bottom surface of the recess 140 of the housing 1.

In assembly, The terminals 3 is interferingly coupled to passageways of the insulative housing 1, then the datum members 2 are inserted into the recesses 140 of the housing 1 each with the leading portion 23 assembled into the second recess 1404 of the housing 1 and the engaging portion 22 inserted into the first recess 1403, at the moment, the hook portion 220 of the engaging portion 22 extends through the first recess 1403 and abuts against the bottom surface of the housing 1. After the datum members 2 assembled into the recess 140 of the housing 1, the datum surface 233 of each datum member 2 protrudes outwardly towards the receiving area 130 for providing a datum surface 233 to the chip module mounted thereon. In this case, the datum surface 233 is provided by a moveable datum member 2, which can be detached from the housing 1, hence the housing 1 can be disposed more passageways than ever for receiving more terminals 3 therein. That is the area of the receiving area 130 adjacent to corners of the housing 1 can be used for defining more passageways. As such, the embodiment described in the invention not only provides a connector 100 with datum surface 233 for facilitating the process of the chip module assembled on housing 1 but also a connector with enlarged area for defining more passageways to receive more terminals therein. So the connector 1 can attains a heighter current and signal transmission than ever.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector for connecting a chip module to a printed circuit board comprising:

an insulative housing comprising a plurality of peripheral walls extending upwardly and interconnecting, and providing a contact receiving surface between said perimeter walls for supporting the chip module thereon, and a number of passageways therethrough;

a number of receiving recess, each comprises a first recess and a second d recess adjacent to the first recess and both arranged on the sidewalls adjacent to the corners thereof inn a thickness direction;

a pair of supporting members assembled on the peripheral wall;

a number of terminals receiving in corresponding passageways of the housing;

at least one detachable datum member arranged on the perimeter walls corresponding the numbers of datum members for providing a datum surface to the chip module received in the housing, which includes a base portion, an engaging portion extending upwardly from the base portion, a leading portion extending from the base portion substantially parallel to the engaging portion and disposed separately with the engaging portion.

2. The connector as recited in claim 1, wherein the housing further defines a supporting bracket protruding outwardly from an upper surface of the housing united with the supporting members as one for supporting the chip module thereon.

3. The connector as recited in claim 1, wherein the datum members are symmetric arranged in the recess disposed on sidewalls adjacent to corners each with the engaging portion inserted into the first recess, the leading portion inserted into the second recess, and a hook of the engaging member extending through the recess and abutting against a bottom surface of the housing.

4. The connector as recited in claim 3, wherein the housing further defines number protruding members each having same height with that of the hook portion extending outwardly from the recess for providing a common plane to support the housing thereon.

5. An electrical connector for connecting a chip module to a printed circuit board comprising:

an insulative housing comprising a plurality of perimeter walls extending upwardly and interconnecting and providing a contact receiving surface between said perimeter walls for supporting the chip module thereon, and a number of passageways therethrough;

a pair of supporting members assembled on the perimeter walls, separately;

a number of terminals received in the passageways;

a number of datum members assembled on the housing each with a projected datum surface extending into the receiving area for providing a datum plane for the chip module.

6. The connector as recited in claim 5, wherein said datum member defines an engaging portion, said housing defines a number of recesses on the sidewalls adjacent to corners for receiving the engaging portion therein.

7. An electrical connector for use with a chip module, comprising:

insulative housing having a plurality of peripheral walls commonly defining a chip module receiving cavity therein for receiving said chip module;

a plurality of passageways defined in the housing and close to the peripheral wall;

a plurality of terminals disposed in the corresponding passageways, respectively; and a number of datum members detachable attached to the peripheral walls, an inner face of each of said datum members located inside of an interior face of the corresponding peripheral wall; wherein some of the passageways proximate the datum member are allowed to be aligned with others proximate the corresponding peripheral wall; wherein said inner face of the datum member is dimensioned to be inwardly offset from said interior face of the peripheral wall with a distance adapted for being engaged with an exterior lateral edge of said chip module.

8. The electrical connector as claimed in claim 7, wherein said some of the passageways is provided with the corresponding terminals, respectively, under a condition that said corresponding terminals are inserted into the passageways before the corresponding datum member is assembled to the corresponding peripheral wall.

9. The electrical connector as claimed in claim 7, wherein the peripheral walls are provided with the receiving slots to receive the corresponding datum members therein, respectively.

10. The electrical connector as claimed in claim 7, wherein said datum member is equipped with at least one deflectable latch to lock to the housing.

11. The electrical connector as claimed in claim 7, wherein said datum member defines two plates, which are laterally spaced from each other, to sandwich a portion of the housing therebetween.

* * * * *